US005594540A

United States Patent [19]

Higaya et al.

[11] Patent Number: 5,594,540

[45] Date of Patent: Jan. 14, 1997

[54] FIXING APPARATUS WITH A RELEASE OIL APPLYING MEMBER

[75] Inventors: Toshiaki Higaya, Kawasaki; Yuzo Kouno, Abikoshi; Yukiti Shindou, Yamatoshi, all of Japan

[73] Assignee: Ricoh Company, Ltd., Tokyo, Japan

[21] Appl. No.: 383,181

[22] Filed: Feb. 3, 1995

[30] Foreign Application Priority Data

Feb. 23, 1994 [JP] Japan ..... 6-025580

[51] Int. Cl.[6] ..... G03G 15/20; G03G 21/00

[52] U.S. Cl. ..... 399/326; 349/323

[58] Field of Search ..... 355/284, 289, 355/290, 283

[56] References Cited

U.S. PATENT DOCUMENTS

| | | | |
|---|---|---|---|
| 3,964,431 | 6/1976 | Namiki | 118/60 |
| 4,512,650 | 4/1985 | Kocher | 355/284 |
| 5,061,965 | 10/1991 | Ferguson et al. | 355/284 |
| 5,123,151 | 6/1992 | Uehara et al. | 355/284 X |
| 5,232,499 | 8/1993 | Kato et al. | 355/284 X |
| 5,235,394 | 8/1993 | Mills et al. | 355/284 |
| 5,289,245 | 2/1994 | Menjo | 355/284 |
| 5,406,363 | 4/1995 | Siegel et al. | 355/290 |
| 5,424,819 | 6/1995 | Menjo | 355/284 |

FOREIGN PATENT DOCUMENTS

| | | |
|---|---|---|
| 2436203 | 2/1975 | Germany . |
| 2821914 | 11/1978 | Germany . |
| 4109525 | 10/1991 | Germany . |

OTHER PUBLICATIONS

Abstract of Japanese Patent Laid–Open Publication No. 63–261290.

*Primary Examiner*—Fred L. Braun

*Attorney, Agent, or Firm*—Oblon, Spivak, McClelland, Maier & Neustadt, P.C.

[57] ABSTRACT

A fixing apparatus includes a fixing roller having a peeling-off layer at its peripheral surface, a rotating member for coming into contact with and for pressurizing the fixing roller, an applying member disposed on the fixing roller, and a cleaning member for cleaning the applying member. The applying member has a porous surface layer which is of the same quality as that of the peeling-off layer of the fixing roller, and is filled in oil. A transferring material with non-fixed toner image is nipped and delivered with the fixing roller and the rotating member, and non-fixed toner image on the transferring material is fixed with heat and pressure.

5 Claims, 2 Drawing Sheets

FIXING APPARATUS WITH A RELEASE OIL APPLYING MEMBER

BACKGROUND OF THE INVENTION

1. Field of the Invention

The present invention relates to a fixing apparatus used in an image forming apparatus in an electrophotographic method such as a copier, a facsimile, and a printer.

More particularly, the invention is concerned with a fixing apparatus which has a fixing roller and a rotating member. The fixing roller has a peeling-off layer at its peripheral surface. The rotating member comes into contact with and pressurizes the fixing roller. A transferring material with non-fixed toner image is nipped and delivered with the fixing roller and the rotating member. A non-fixed toner image on the transferring material is fixed with heat and pressure.

2. Discussion of the Background

In a fixing apparatus which is disposed in an image forming apparatus for using toner particles, toner is melted and is stuck on a transferring material with heat from a fixing roller. If a peeling-off property of the fixing roller is inferior, offset occurs in which part of toner is attached to the fixing roller. A peeling-off layer is disposed on a surface of the fixing roller and silicone oil is applied to the fixing roller so that the peeling-off property of the fixing roller is improved. Various kinds of silicone oil applying devices are utilized. It is well-known that an applying roller has a surface layer with an infinite number of holes and is filled in oil. In the above-mentioned fixing apparatus equipped with the applying roller, oil can be applied to the fixing roller thinly and uniformly. An oil stain does not appear on the transferring material because the peeling-off property of the fixing roller is improved and an excess of applying oil does not occur.

However, it is difficult to eliminate the offset, even if the peeling-off property of the fixing roller is improved. A small amount of offset remains on the fixing roller. In the fixing apparatus equipped with the applying roller with an infinite number of holes, the surface layer of the applying roller is stained with toner and paper particles. With the passage of time, an oil applying amount from the applying roller decreases. The stain on the applying roller is retransferred to the fixing roller. This therefore raises a problem to be solved in that the transferring material is stained.

SUMMARY OF THE INVENTION

It is therefore, an object of the present invention to provide for a fixing apparatus in which the applying member cannot easily be contaminated with toner.

It is another object of the present invention to provide for a fixing apparatus in which a stain attached on the applying member can be cleaned by the cleaning member.

It is another object of the present invention to provide for a fixing apparatus which is capable of preventing the image quality from deteriorating.

In order to achieve the above-mentioned objects, according to the present invention, there is provided a fixing apparatus which includes a fixing roller having a peeling-off layer at its peripheral surface, a rotating member for coming into contact with and for pressurizing the fixing roller, an applying member disposed on the fixing roller, and a cleaning member for cleaning the applying member. The applying member has a porous surface layer which is of the same quality as that of the peeling-off layer of the fixing roller, and is filled in oil.

A transferring material with non-fixed toner image is nipped and delivered with the fixing roller and the rotating member, and non-fixed toner image on the transferring material is fixed with heat and pressure.

BRIEF DESCRIPTION OF THE DRAWINGS

The above and other objects, features and advantages of the present invention will become more apparent from the following detailed description when considered in connection with the accompanying drawings, in which:

FIG. 3(*a*) is an enlarged partial sectional view of the surface layer of the cleaning member.

DESCRIPTION OF THE PREFERRED EMBODIMENTS

Figure 1:
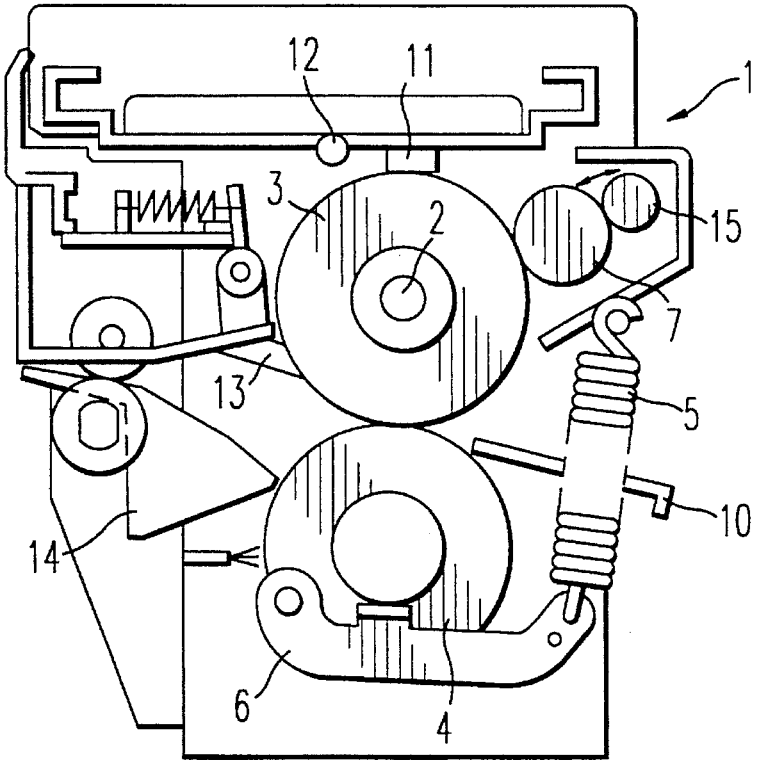
FIG. 1 is a section showing a fixing apparatus in accordance with the present invention.

Referring now to the drawings, wherein like reference numerals designate identical or corresponding parts throughout the several views, FIG. 1 is a section showing the fixing apparatus in accordance with the present invention.

Referring to FIG. 1, a fixing apparatus 1 is provided with a fixing roller 3 which accommodates a heater 2 and a pressurizing roller 4 as a rotating member. The pressurizing roller 4 comes into contact with and pressurizes the fixing roller 3 by a spring 5 via a pressurizing arm 6. The fixing roller 3 and the pressurizing roller 4 are rotatably disposed on the fixing apparatus 1 through bearings (not shown). The fixing roller 3 is connected with moving means such as gears (not shown). In the fixing roller 3 of this embodiment, a journal of the fixing roller 3 is made of aluminum, and a surface layer as a peeling-off layer is made of fluororesin. PFA (tetra-fluoro ethylene-per-fluoro alkyle vinyl ethel copolymer) or PTFE (polytetrafluoroethylene) are used in processing of fluororesin.

As shown FIG. 1, the fixing apparatus 1 has an inlet guide 10, a thermistor 11, a temperature fuse 12, a separating claw 13, and an outlet guide 14.

Figure 2:
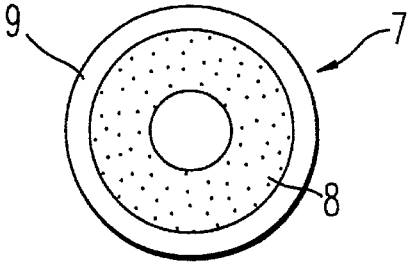
FIG. 2 is a section showing the enlarged applying member of the FIG. 1.

FIG. 2 is a section showing an enlarged applying member of FIG. 1. Referring to FIG. 2, an applying roller 7 as the applying member comes into contact with the fixing roller 3, and is driven by the rotation of the fixing roller 3. The applying roller 7 has a roller core member 8 made of foaming material and a surface layer 9 with an infinite number of minute holes. The surface layer 9 is of the same quality as that of the peeling-off layer of the fixing roller 3, and is made of fluororesin such as PTFE. The roller core member 8 is filled in silicone oil. When the fixing roller 3 is rotated, silicone oil of the roller core member 8 oozes from the minute holes of the surface layer 9, and is applied to the surface of the fixing roller 3 thinly and uniformly.

As the surface layer 9 of the applying roller 7 is of the same quality as that of the peeling-off layer of the fixing roller 3, there is no difference in peeling-off action between the peeling-off layer and the surface layer and also no difference in temperature therebetween. Therefore, it is difficult that toner attached on the fixing roller 3 is transferred to the applying roller 7, and the amount of toner transferred to the applying roller 7 decreases. Most of toner attached on the fixing roller 3 is transferred not to the applying roller 7 but to the transferring material such as transferring paper. The applying roller 7 cannot be easily contaminated with toner.

In the above-mentioned fixing apparatus 1, it is difficult to avoid that a small amount of toner is attached to the applying roller 7. A cleaning roller 15 as a cleaning member is disposed on the fixing apparatus 1. The cleaning roller 15 comes into contact with the applying roller 7 and is rotated.

Figure 3A:
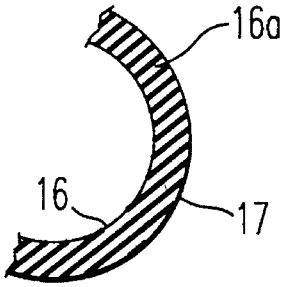
FIG. 3 is a section showing the enlarged cleaning member of the FIG. 1.
Figure 3:
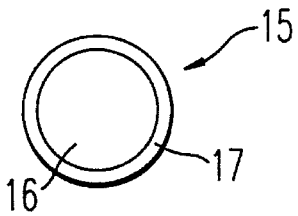

FIG. 3 is a section showing the enlarged cleaning member of FIG. 1. Referring to FIG. 3, the cleaning roller 15 has a metallic roller 16 and a surface layer 17. The surface of the metallic roller 16 is coated with fluorinated rubber as the surface layer 17 with thickness of 10~100μ. The surface layer 17 of the cleaning roller 15 is not the same quality as that of the surface layer 9 of the applying roller 7. The peeling-off quality of the surface layer 17 of the cleaning roller 15 is inferior to that of the surface layer 9 of the applying roller 7. There is a difference in temperature between the surface layer 17 of the cleaning roller 15 and the surface layer 9 of the applying roller 7. Therefore, the cleaning roller 15 securely cleans stains such as toner, paper particles attached to the applying roller 7 and the surface of the applying roller 7 is kept without stains.

In addition, the surface of the metallic roller 16 is coated with fluorinated rubber as the surface layer 17 with thickness of 0.5 mm~2 mm so as to increase the elasticity of the surface layer 17.

Further, a silicone rubber layer 16*a* is disposed between the metallic layer 16 and the surface layer 17 of the cleaning roller 15 as illustrated in the enlarged partial sectional view of FIG. 3(*a*). The silicone rubber layer has a property of low hardness, whose scale is less than 20 (JIS Japanese Industrial Standard Type-A hardness K-6301) so as to increase the elasticity of the surface layer 17.

In the above-mentioned cleaning roller 15, a nip portion between the applying roller 7 and the cleaning roller 15 increases so as to enlarge a cleaning portion.

Figure 4:
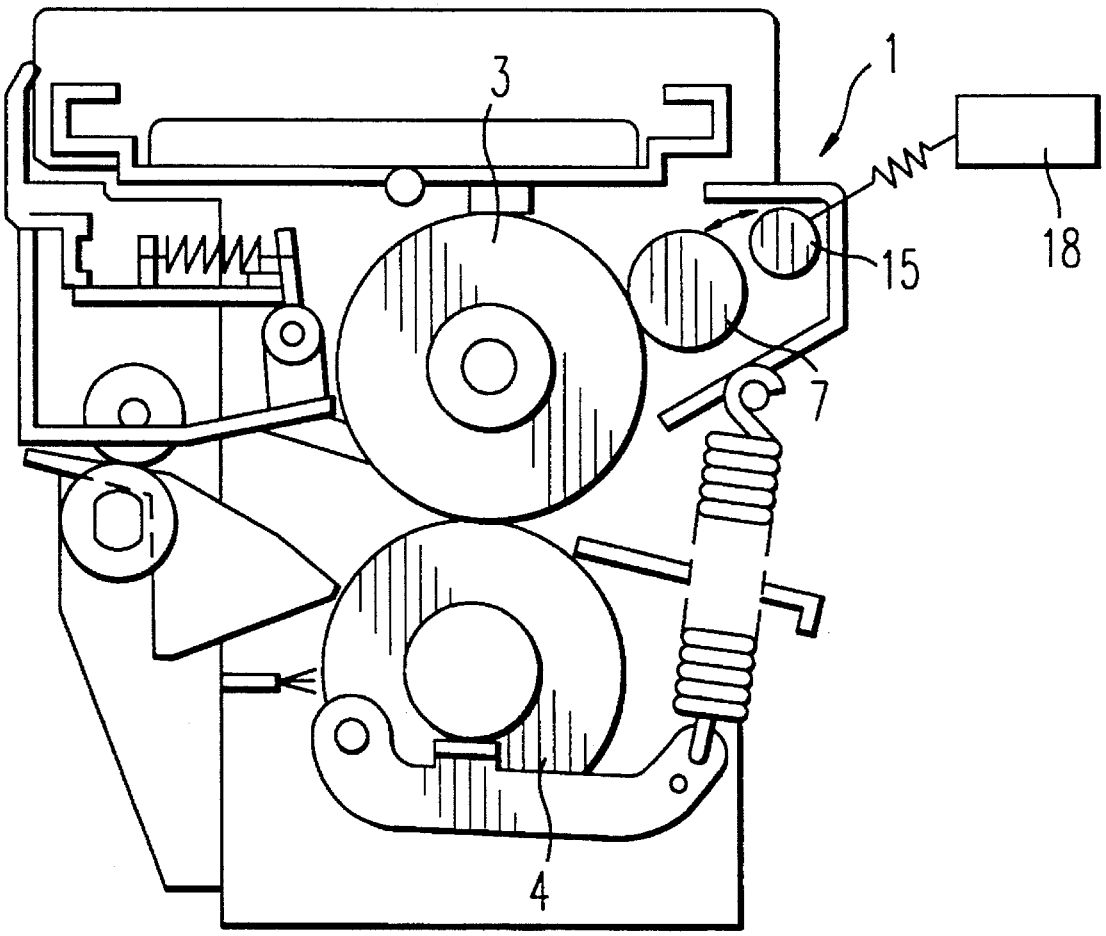
FIG. 4 is a section showing a further fixing apparatus in accordance with the present invention.

FIG. 4 is a section showing a further fixing apparatus in accordance with the present invention. Referring to FIG. 4, the fixing apparatus 1 is provided with a contacting and separating mechanism 18 for contacting the cleaning roller 15 with the applying roller 7 and for separating the cleaning roller 15 from the applying roller 7.

The contacting and separating mechanism 18 is provided with a backward/forward moving means such as an eccentric cam or solenoid so as to move the cleaning roller 15 backward or forward.

When the fixing roller 3 is rotated in an operating state of the fixing apparatus 1, the contacting and separating mechanism 18 contacts the cleaning roller 15 with the applying roller 7.

When the fixing roller 3 is stopped in a non-operating state of the fixing apparatus 1, the contacting and separating mechanism 18 separates the cleaning roller 15 from the applying roller 7.

Even if the fixing apparatus 1 is kept in a non-operating state for a long period of time, the minute holes on the surface layer 9 of the applying roller 7 cannot be choked with stains such as toner and paper particles.

Also, in the case that toner with low melting point is used in the above-mentioned fixing apparatus 1 and the fixing apparatus 1 is kept in a non-operating state for a long period of time under a high temperature condition, toner attached on the cleaning roller 15 is melted. But melted toner cannot be re-transferred to the surface layer 9 of the applying roller 7 because the cleaning roller 15 is separated from the applying roller 7.

When an image forming apparatus having the abovementioned fixing apparatus 1 performs an image forming, the cleaning roller 15 comes into contact with the applying roller 7 after the fixing roller 3 is initiated to rotate and before the transferring material arrives at the fixing apparatus 1. The cleaning roller 15 is separated from the applying roller 7 after the transferring material is discharged from the fixing apparatus and before the fixing roller 3 stops rotating.

Therefore, the image quality of the transferring material cannot be deteriorated.

In the above-mentioned embodiments of FIG. 1 and FIG. 4, the cleaning roller 15 is used as the cleaning member. A plate-shaped or non-rotating member can be applied to the present invention. In this case, the prescribed amount of stain remains between the applying roller 7 and the cleaning member so that applying roller 7 cannot be contaminated with stain for a certain period. Various kinds of fixing apparatuses having the fixing roller can be applied to the present invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A fixing apparatus comprising:

a fixing roller having a peeling-off layer at a peripheral surface of said fixing roller;

a rotating member for coming into contact with and for pressurizing said fixing roller;

a rotatable applying member disposed so as to contact said fixing roller, said rotatable applying member having a fluororesin porous surface layer which has a plurality of minute holes and is of a same quality as that of said peeling-off layer of said fixing roller, and a core member made of foaming material which is filled in oil, such that a rotation of said fixing roller causes a rotation of said applying member so as to permit oil in said core member to pass through the minute holes and be applied to the peripheral surface of the fixing roller; and a cleaning roller member for cleaning said applying member, said cleaning roller member including a metallic roller and a fluorinated rubber surface layer on said metallic roller which is not of a same quality as that of said porous surface layer of said applying member, said cleaning roller member further including a silicone rubber layer disposed between the metallic roller and the fluorinated rubber surface layer, said silicone rubber layer having a low hardness which increases an elasticity of the fluorinated rubber surface layer;

wherein a transferring material with non-fixed toner image is nipped and delivered with said fixing roller and said rotating member, and non-fixed toner image on said transferring material is fixed with heat and pressure.

2. A fixing apparatus according to claim 1, further comprising:

a contacting and separating mechanism for contacting said cleaning roller member with said applying member and for separating said cleaning roller member from said applying member.

3. A fixing apparatus according to claim 2, wherein said contacting and separating mechanism contacts said cleaning roller member with said applying member when said fixing roller is rotated, and separates said cleaning roller member from said applying member when said fixing roller is not rotated.

4. A fixing apparatus according to claim 2, wherein said contacting and separating mechanism contacts said cleaning roller member with said applying member after said fixing roller is initiated to rotate and before said transferring material arrives at said fixing apparatus, and said contacting and separating mechanism separates said cleaning roller member from said applying member after said transferring material is discharged from said fixing apparatus and before said fixing roller stops rotating.

5. A fixing apparatus comprising:

a fixing roller having a peeling-off layer at a peripheral surface of said fixing roller;

a rotating member for coming into contact with and for pressurizing said fixing roller;

an applying roller disposed so as to contact said fixing roller, said applying roller having a porous surface layer which is of a same quality as that of said peeling-off layer of said fixing roller, and is filled in oil;

a cleaning roller for cleaning said applying roller, said cleaning roller including a metallic roller and a fluorinated rubber surface layer on said metallic roller which is not of a same quality as that of said porous surface layer of said applying roller, said cleaning roller further including a silicone rubber layer disposed between the metallic roller and the fluorinated rubber surface layer, said silicone rubber layer having a low hardness which increases an elasticity of the fluorinated rubber surface layer; and a contacting and separating mechanism for directly contacting said cleaning roller with said applying roller and for separating said cleaning roller from said applying roller;

wherein:

said contacting and separating mechanism contacts said cleaning roller with said applying roller when said fixing roller is rotated so as to enlarge a cleaning area between said cleaning roller and said applying roller when said cleaning roller contacts said applying roller, and separates said cleaning roller from said applying roller when said fixing roller is not rotated; and a transferring material with non-fixed toner image is nipped and delivered with said fixing roller and said rotating member, and non-fixed toner image on said transferring material is fixed with heat and pressure.

* * * * *